United States Patent [19]

LeBlanc et al.

[11] 4,429,868

[45] Feb. 7, 1984

[54] CALF STRETCHING DEVICE

[75] Inventors: James S. LeBlanc, San Diego; Alan K. Uke, Solana Beach, both of Calif.

[73] Assignee: Paraflexor, San Diego, Calif.

[21] Appl. No.: 299,022

[22] Filed: Sep. 3, 1981

[51] Int. Cl.[3] ..... A63B 23/04

[52] U.S. Cl. ..... 272/93; 272/144

[58] Field of Search ..... 128/25 B; 272/93, 96, 272/105, 109, 144, 125; 188/32, 23; 40/610, 606, 612; 248/460, 37.3

[56] References Cited

U.S. PATENT DOCUMENTS

| | | | |
|---|---|---|---|
| 956,681 | 5/1910 | Clarke | 272/96 |
| 2,021,801 | 11/1935 | Meyer | 128/25 B |
| 2,210,626 | 8/1940 | Femina | 248/460 |
| 2,554,718 | 5/1951 | Oleskey | 128/80 |
| 3,159,141 | 12/1964 | Paterek | 272/144 |
| 3,361,427 | 1/1968 | Paves | 272/57 |
| 3,472,508 | 10/1969 | Baker et al. | 272/57 |
| 3,671,040 | 6/1972 | Meyer et al. | 273/326 |
| 4,253,260 | 3/1981 | Maza et al. | 40/610 |

OTHER PUBLICATIONS

"The Jumper", Coach and Athlete, 3-1981, p. 31.

*Primary Examiner*—Richard C. Pinkham

*Assistant Examiner*—Matthew Schneider

*Attorney, Agent, or Firm*—Brown & Martin

[57] ABSTRACT

A device for aiding a person using the device in stretching his or her calves which comprises a pair of generally rectangular members which are hingedly connected along corresponding longitudinal edges to permit relative swinging movement of the members. The members may be swung from a collapsed storage configuration, having a distance up one surface of the A-frame configuration substantially equivalent to the length of the feet of the person using the device in which they overlie each other to a substantially A-frame configuration. A linkage mechanism in the form of a pair of pivotally connected arms extends between the undersides of the rectangular members to limit the amount that the members can swing apart. When the deivce rests on the floor in its A-frame configuration, the upper side of at least one of the rectangular members is inclined at a predetermined desired angle, for example forty-five degrees with respect to the floor. A person may stand on that upper side with both of his or her feet upwardly inclined, moving from heel to toe, and his or her calves will be statically stretched. When the device is to be stored, the rectangular members can be swung together and the linkage arms will fold into the interior of the device.

10 Claims, 11 Drawing Figures

CALF STRETCHING DEVICE

BACKGROUND OF THE INVENTION

The present invention relates to apparatus utilized for maintaining physical fitness, and more particularly, to a device that aids a person in stretching his or her calves.

The slow, gradual pulling, holding and releasing of specific muscle groups, known as static stretching, has recently superseded ballistic type calisthenics in the regime of flexibility training followed by amateur and professional athletes. Today the important relationship between flexibility and strength, endurance, and speed has come to be appreciated. It is now understood that flexibility not only aids overall physical performance, but in addition protects against muscle soreness and injury. A more indepth discussion of the benefits of utilizing static stretching to improve flexibility may be found in the article entitled "Flexibility: Day Of The Static Stretch" by Paul Schultz published in the periodical "The Physician and Sportsmedicine", Volume 7, Number 11, November, 1979.

In static stretching, the body is positioned to lock the joints around a muscle when the muscle is in its greatest possible length with as little concomitant muscle activity as possible. The result is the least possible reflex stimulation to the muscle involved.

At the present time, athletes, such as runners, perform static stretching of their calves. Most typically this is accomplished by placing one or both feet flat on the floor and by leaning forward, while grasping a railing or placing the palms against an adjacent wall to forwardly incline the lower legs with respect to the feet. It is difficult to maintain the desired inclined relationship between the lower legs and the feet in this fashion. Furthermore, it is difficult to precisely monitor the degree of stretching with this approach.

U.S. Pat. No. 956,681 of Clarke discloses a folding foot rest which includes a rectangular foot supporting member having a pair of hinge supporting mechanisms connected at the opposite ends of the member and to the floor. U.S. Pat. No. 3,361,427 of Paves discloses an exercise rocker for a person's feet. It includes a rectangular planar support member having a longitudinally extending arch support member with spaced apart recesses for receiving the arches of the operator's feet. A pair of ribs are connected to the underside of the planar support member at opposite ends thereof for permitting back and forth rocking motion. U.S. Pat. No. 2,554,718 of Oleskey discloses a foot correcting device upon which a person can stand to impart a transverse incline to his or her foot. Finally, U.S. Pat. No. 3,472,508 of Baker et al. discloses a wedge-shaped shoe device which may be strapped to the foot to incline the foot from heel to toe for exercising the calf muscles.

SUMMARY OF THE INVENTION

Accordingly, it is the primary object of the present invention to provide a device that will aid a person in stretching his or her calves.

It is another object of the present invention to provide such a calf stretching device which has a simple, durable construction and which may be collapsed into a compact configuration for carrying and storage.

Another object of the present invention is to provide a leg stretching device of the aforementioned type which is assembled from pairs of parts having identical, complementary configurations so that the device can be inexpensively manufactured from injection molded plastic.

Accordingly, the present invention provides a device for aiding a person in stretching his or her calves which comprises a pair of generally rectangular members which are hingedly connected along corresponding longitudinal edges to permit relative swinging movement of the members. The members may be swung from a collapsed storage configuration in which they overile each other to a substantially A-frame configuration. A linkage mechanism in the form of a pair of pivotally connected arms extends between the undersides of the rectangular members to limit the amount that the members can swing apart. When the device rests on the floor in its A-frame configuration, the upper side of at least one of the rectangular members is inclined at a predetermined desired angle, for example forty-five degrees, with respect to the floor. A person may stand on that upper side with both of his or her feet upwardly inclined, moving from heel to toe, and his or her calves will be statically stretched. When the device is to be stored, the rectangular members can be swung together and the linkage arms will fold into the interior of the device.

The upper side of the rectangular member on which the person stands is dimensioned so that the distance between the opposing longitudinal edges is substantially equivalent to the length of the feet of the person using the device, and it may be provided with a textured, non-slip surface. The hinge which connects the rectangular members may comprise a plurality of rounded, interleaved fingers which extend from the opposing longitudinal edges of the rectangular members. These flanges have aligned holes therein through which extends a hinge pin. This type of hinge is desirable because of its compactness and further because it minimizes the likelihood of a person pinching his or her fingers when the device is collapsed. The bottom longitudinal edge of at least one of the rectangular members may be provided with a friction enhancing element. This element may be made of a resilient material and may have a plurality of adjacent, longitudinally extending flanges which extend away from the device and engage the floor to prevent the device from sliding.

The device may be utilized to stretch the calf muscles of the lower leg, and specifically, the gastrocnemius, soleus and plantaris muscles. It provides a convenient and stable way for flexion of the foot upon the lower leg to some predetermined desired angle, for example forty-five degrees. This compliments the foot/ankle/leg structure. Study has indicated that forty-five degrees is the preferred maximum allowable flexion of the foot relative to the lower leg due to anatomical considerations involving the tibia (lower leg bone) and the talus (ankle bone directly beneath the lower leg bone).

Static stretching which is made easy with the device of the present invention is beneficial because it lengthens the lower leg muscles, allowing for unprecedented flexibility. Such flexibility enables freer, more fluid, less encumbered movement. Stiff calf muscles create a tight ankle whih causes an unnatural gait, resulting in greater stress on subsequent joints, for example the knee, hip and low back. Static stretching accomplished with the device of the present invention helps to both prevent and relieve chronic muscular soreness. In addition, persons recently out of an ankle or lower leg cast in which the ankle has been held immobile can utilize the device to regain flexibility in the lower leg. Runners, athletes of all types, high heel shoe wearer, dancers, and any ambulatory persons may gain benefits from the use of the device disclosed herein.

DESCRIPTION OF THE PREFERRED EMBODIMENTS

Figure 1:
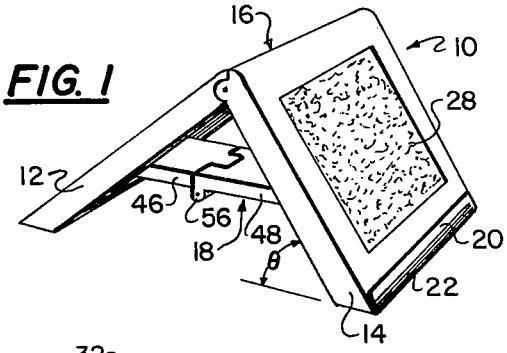
FIG. 1 is a perspective view of a preferred embodiment of the calf stretching device in its unfolded, A-frame configuration.
Figure 2:
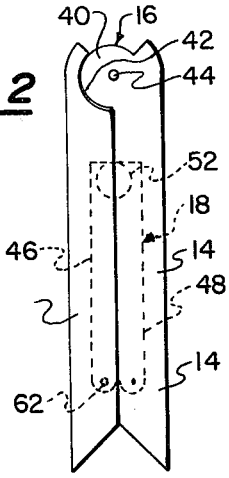
FIG. 2 is an enlarged, end elevation view of the device of FIG. 1 in its collapsed storage configuration.
Figure 3:
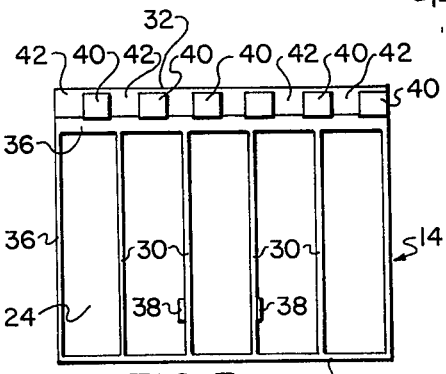
FIG. 3 is a reduced plan view of the lower side of one of the rectangular members of the device of FIG. 1.
Figure 5:
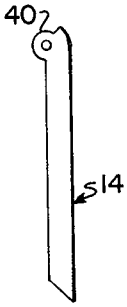
FIG. 5 is an elevation view taken from the right hand end of the rectangular member of FIG. 3.
Figure 6:
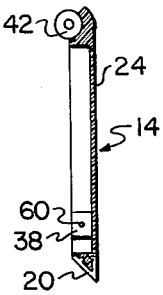
FIG. 6 is a sectional view of the rectangular member of FIG. 4 taken along line 6—6 of FIG. 4.

Referring to FIG. 1, there is illustrated therein a preferred embodiment 10 of the calf stretching device of the present invention. It includes a pair of rectangular members 12 and 14 which are connected by hinge means generally designated 16 along a pair of their longitudinal edges. The members may be held in an A-frame configuration by foldable linkage means 18 connected between the lower sides of the members. The lower longitudinal edge of the member 14 is beveled so that it can rest substantially flat with respect to the floor, and it has a friction enhancing element 20 connected therealong between the lower longitudinal edge and the floor so that the lower longitudinal edge can rest on the element which can in turn rest on the floor. FIG. 6 is a sectional view showing the position of the element. The element 20 has an inverted A-shaped cross-section. The element 20 is preferably made of a resilient material such as synthetic rubber and has a plurality of adjacent, longitudinally extending flanges 22 which extend away from the member and engage the floor on which the device rests. The hinge means 16 permits the members 12 and 14 to be swung together as shown in FIG. 2 to collapse the device for storage and transport. When the rectangular members are swung together, the linkage means folds inwardly and upwardly into the compact configuration shown in phantom lines in FIG. 2.

Preferably, the rectangular members 12 and 14 have identical, complementary configurations. The configuration of each of the members is shown in greater detail in FIGS. 3–6. The advantage of having a complementary configuration for each of the rectangular members 12 and 14 lies in the fact that they may be fabricated utilizing a single mold, thereby reducing fabrication costs. By way of example, the members may be made by injecting a suitable plastic into a mold under appropriate temperature and pressure conditions. One suitable plastic is ABS foam. The other components of the calf stretching device hereafter described may be similarly manufactured of the same plastic material. Such a plastic construction permits high volume manufacture at relatively low cost while producing a device which is relatively high in strength and relatively low in weight.

The construction of each of the rectangular members 12 and 14 may now be described in further detail by way of reference to FIGS. 3–6. Each member, such as 14 is dimensioned so that the distance between first and second longitudinal edges 32 and 34 (FIGS. 4 and 10) is substantially equivalent to the length of the feet of the person using the device, and it includes a rectangular planar portion 24 which defines the upper side 26 of the member. As shown in FIG. 1, preferably the upper surface of the planar portion 24 is provided with a textured surface 28. The area of the upper side 26 of the member 14 is sufficient for supporting both of a person's feet in side by side arrangement. The textured surface 28 helps to prevent the person's feet from slipping on the device.

The member 14 is further provided with a plurality of spaced apart support ribs 30 (FIG. 3) which are connected to the lower surface of the planar portion 24 and extend between first and second longitudinal edges 32 and 34 of the member. The underside of the member 14 is further formed with four edge walls 36 which extend downwardly from the upper side of the member along the outer perimeter thereof. The pair of support ribs 30 which are closest to the center of the member 14 are each provided with bosses 38 which form part of the means which pivotally connects the opposite ends of the linkage means 18 (FIG. 1) to the underside of the members 12 and 14.

Referring again to FIGS. 3–6, the upper longitudinal edge of each of the members, such as 14, is formed with a plurality of rounded fingers 40 which are spaced equal distances apart by recesses 42 formed therebetween. The hinge means 16 thus comprises a plurality of interleaved fingers 40 extending from opposite ones of the members 12 and 14. Each finger 40 from one member is received in a corresponding recess 42 in the other member as indicated in FIG. 2. Each of the fingers is formed with a hole through the center thereof through which extends a hinge pin 44 (FIG. 2). Due to the close tolerances between the holes in the fingers and the diameter of the hinge pin 44, the pin stays in place when the members 12 and 14 are articulated.

Thus, the illustrated construction of the hinge means 16 which connects the rectangular members 12 and 14 provides a strong junction along the opposing joined edges of the members. In addition, the hinge means 16 is unobtrusive and has no parts which extend therefrom when the device is collapsed as shown in FIG. 2. Furthermore, the design of the hinge means minimizes the risk of having a person's finger pinched when the device is collapsed.

FIG. 6 further illustrates the location of the bosses 38 and the configuration of the friction enhancing element 20. This element may be extruded from a suitable resilient material and may have teeth which fit within corresponding recesses in the lower longitudinal edge of the member 14 to hold the element in place.

Figure 8:
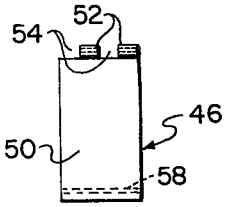
FIG. 8 is an enlarged top plan view of one of the linkage arms of the device of FIG. 1.
Figure 4:
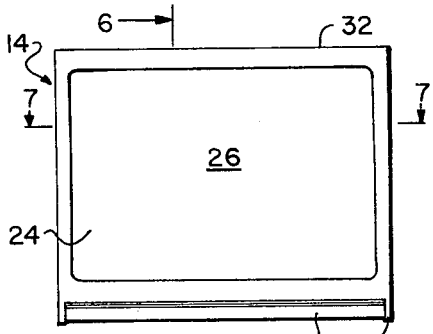
FIG. 4 is a plan view of the upper side of the rectangular member of FIG. 3.
Figure 9:
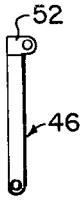
FIG. 9 is an elevation view of the linkage arm of FIG. 8 taken from the left hand end in FIG. 8.
Figure 7:
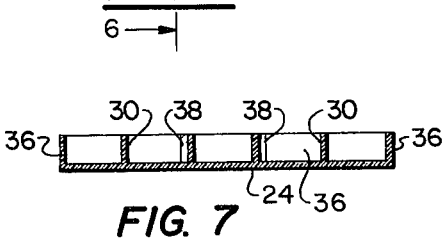
FIG. 7 is a sectional view of the rectangular member of FIG. 4 taken along line 7—7 of FIG. 4.

Details of the linkage means 18 (FIG. 1) are illustrated in FIGS. 8 and 9. As shown in FIGS. 1, 8 and 9, the linkage means 18 comprises a pair of arms 46 and 48 which are pivotally connected at their one ends to each other and pivotally connected at the other ends to the undersides of corresponding ones of the rectangular members 12 and 14. Each of the arms, such as 46 (FIG. 8) includes a rectangular body portion 50 and a pair of spaced apart fingers 52 formed at one end of the body portion. Preferably, the linkage arms 46 and 48 have identical, complementary configurations so that they can be inexpensively fabricated with the same mold and of material like that of which the members 12 and 14 are made.

As shown in FIG. 1, the fingers 52 of each of the arms are interleaved. In other words, the fingers 52 of the arm 48 are received in the recesses 54 (FIG. 8) between the fingers of the other arm 46, and visa versa. Holes are formed in the center of the fingers 52 as indicated by the phantom lines in FIG. 8. A second hinge pin 56 (FIG. 1) extends through the holes of each of the fingers to pivotally connect the arms. The fingers 52 are rounded as shown in FIG. 9. When the rectangular members 12 and 14 are swung together to the positions shown in FIG. 2, the arms 46 and 48 swing upwardly to the folded configuration shown in phantom lines.

The ends of each of the arms opposite from the fingers 52 also have holes therethrough as indicated by the phantom lines 58 in FIG. 8. The lateral dimension of the arm 46 (left and right in FIG. 8) is just small enough to permit the arm to fit between the centermost pair of the support ribs 30 (FIG. 3) in alignment with the bosses 38. As shown in FIG. 6, each of the bosses 38 and the rib to which it is formed have holes 60 therethrough. Another hinge pin 62 extends through the holes 60 in each of the bosses 38, through the centermost support ribs 30 and through the hole 58 in the corresponding one of the linkage arms to pivotally connect that linkage arm to the underside of its corresponding rectangular member. As in the case of the main hinge means 16, each of the hinge pins 56 and 62 and the corresponding holes through which they fit are toleranced so that these hinge pins remain in position during repeated opening and closing of the calf stretching device.

Figure 10:
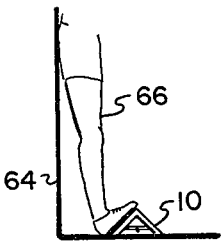
FIGS. 10 and 11 are simplified views illustrating the manner in which a person may utilize the device of FIG. 1 to stretch his or her calves.
Figure 11:
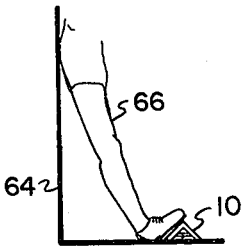

The linkage means 18 is dimensioned for limiting the amount that the rectangular members 12 and 14 can be swung apart so that the upper side of at least one the members 12 and 14 will be inclined at a predetermined desired angle theta (FIG. 1) with respect to the floor when the lower remote edges of each of the members rest on the floor as shown in FIGS. 10 and 11. Preferably the combined length of the arm 46 and 48 and their attachment points to the members are chosen so that the angle theta will be approximately forty-five degrees. In the illustrated embodiment, the rectangular members 12 and 14 are equally inclined with respect to the floor.

FIGS. 10 and 11 illustrate the utilization of the device of FIG. 1. The device 10 is swung open to its A-frame configuration and placed on the floor adjacent a vertical wall 64 or other vertical support. A person 66 then places both of his or her feet on the upper side of the rectangular member closes to the wall with his or her feet upwardly inclined moving from heel to toe. The posterior of the person is placed against the wall 64 in order to maintain balance. It can be seen that when the person has his or her feet upwardly inclined with the device of the present invention, static stretching of the calf muscles will take place. FIG. 11 illustrates the fact that the device 10 may be placed further away from the wall 64 to reduce the degree of static stretching of the calf muscles.

Having described a preferred embodiment of our calf stretching device. It should be apparent to those skilled in the art that our invention permits of modification in both arrangement and detail. For example, the illustrated hinge means could be replaced a strip of fabric woven from a high strength synthetic material such as that sold under the trademark NYLON. This strap would be secured at its opposite ends to the undersides of the rectangular members 12 and 14. The amount that the fabric would stretch under the loading conditions imposed by a person standing on one of the members as shown in FIG. 10 would have to be determined. This would enable the appropriate length of fabric to be chosen that would limit the amount that the members would move apart under a human load while still achieving the desired forty-five degree angle theta. However, such modifications, as well as others, will occur to those skilled in the art. Therefore, the protection afforded our invention should be limited only in accordance with the scope of the following claims.

We claim:

1. A device to aid a person using the device in stretching his or her calves, comprising:

a pair of generally rectangular members each having an upper side, a lower side, a first longitudinal edge and a second longitudinal edge opposite the first longitudinal edge, at least one of the upper sides being dimensioned so that the distance between the first longitudinal edge and the second longitudinal edge is substantially equivalent to the length of the feet of the person using the device and so that it has sufficient area to support both of the person's feet;

hinge means for connecting the members along their first edges and permitting relative swinging movement of the members; and linkage means connected between the lower sides of the members for permitting the members to swing together and for limiting the amount that the members can swing apart so that when the second edges of the members rest on a floor, the one upper side will be inclined at a predetermined desired angle with respect to the floor;

whereby the person may stand on the one upper side with both of his or her feet upwardly inclined moving from heel to toe and his or her calves will be stretched.

2. A device according to claim 1 wherein the predetermined desired angle with respect to the floor is approximately forty-five degrees.

3. A device according to claim 1 wherein the hinge means includes:

a plurality of interleaved fingers which extend from the first edges of the members along substantially the entire length thereof, the fingers having aligned holes formed therein; and a hinge pin extending through the holes of each of the members.

4. A device according to claim 3 wherein the outer edges of the fingers are rounded.

5. A device according to claim 1 wherein the members have substantially identical, complementary configurations.

6. A device according to claim 1 wherein at least one of the second edges is beveled so that it can rest substantially flat with respect to the floor, and has a friction enhancing element made of a resilient material connected therealong so that the second edge can rest on the friction enhancing element with the friction enhancing element resting on the floor.

7. A device according to claim 1 wherein the linkage means includes:

a pair of arms, each having a plurality of interleaved fingers which extend from one end of each arm, the fingers having aligned holes formed therein;

a hinge pin extending through the holes of each of the arms;

means for pivotally connecting the other end of each arm to the lower side of a corresponding one of the rectangular members; and means for causing the arms to fold upwardly with respect to the floor when the rectangular members swing together.

8. A device according to claim 1 wherein the one upper side is formed with a friction enhancing texture to inhibit downward slippage of the feet of the person using the device.

9. A device according to claim 1 wherein the lower side of each rectangular member is provided with a plurality of spaced apart support ribs.

10. A device according to claim 1 wherein the rectangular members are made of plastic which has been injected into identical molds.

* * * * *